US011084030B2

(12) United States Patent
Dudek et al.

(10) Patent No.: US 11,084,030 B2
(45) Date of Patent: Aug. 10, 2021

(54) PIPETTE FOR SAMPLING AN EXTENDED RANGE OF VOLUMES OF LIQUID

(71) Applicant: Gilson SAS, Villiers-le-Bel (FR)

(72) Inventors: Bruno Dudek, Orry-la-Ville (FR); Stéphane Guichardon, Bougival (FR)

(73) Assignee: GILSON SAS, Villiers-le-Bel (FR)

( * ) Notice: Subject to any disclaimer, the term of this patent is extended or adjusted under 35 U.S.C. 154(b) by 364 days.

(21) Appl. No.: 16/091,132

(22) PCT Filed: Apr. 11, 2017

(86) PCT No.: PCT/EP2017/058597
§ 371 (c)(1),
(2) Date: Oct. 4, 2018

(87) PCT Pub. No.: WO2017/178448
PCT Pub. Date: Oct. 19, 2017

(65) Prior Publication Data

US 2019/0151839 A1 May 23, 2019

(30) Foreign Application Priority Data

Apr. 12, 2016 (FR) ..... 16 53223

(51) Int. Cl.
*B01L 3/02* (2006.01)

(52) U.S. Cl.
CPC ..... *B01L 3/0231* (2013.01); *B01L 3/0227* (2013.01); *B01L 2400/0478* (2013.01)

(58) Field of Classification Search
None
See application file for complete search history.

(56) References Cited

U.S. PATENT DOCUMENTS 3,741,732 A * 6/1973 Stanfield ..... A61B 5/150022 73/864.02
3,757,585 A * 9/1973 Heller ..... A61M 1/00 73/864.18
4,036,064 A * 7/1977 Hydo ..... G01N 35/0095 73/864.17

(Continued)

FOREIGN PATENT DOCUMENTS

FR 3 019 895 A1 10/2015
JP H02218961 A 8/1990

OTHER PUBLICATIONS

International Search Report for International Application No. PCT/EP2017/058597 dated May 12, 2017.

(Continued)

*Primary Examiner* — Brian R Gordon
(74) *Attorney, Agent, or Firm* — Pearne & Gordon LLP

(57) ABSTRACT

A pipette for sampling an extended range of volumes of liquid includes a fixed pipette body. An operating rod is movable in translation relative to the pipette body, along a longitudinal axis of the pipette. The pipette includes a suction chamber and a set of N concentric pistons, wherein N corresponds to an integer greater than or equal to 2. Each of the pistons contributes to delimiting the suction chamber. A coupling module couples the operating rod with the set of N concentric pistons. The module is configured in such a way as to be able to be brought into N distinct configurations in which it respectively couples the operating rod with 1, 2, . . . , N pistons.

15 Claims, 11 Drawing Sheets

(56) References Cited

U.S. PATENT DOCUMENTS 4,056,360 A * 11/1977 Risch ..... A61B 10/0045 73/864.17
4,128,009 A * 12/1978 D'Autry ..... B01L 3/0231 222/309
4,133,211 A * 1/1979 Sarstedt ..... B01L 3/0231 422/927
4,141,250 A * 2/1979 D'Autry ..... B01L 3/0231 222/309
5,696,330 A 12/1997 Heinonen
6,021,680 A * 2/2000 Inagaki ..... B01L 3/0231 73/864.01
6,428,750 B1 * 8/2002 Rainin ..... B01L 3/0224 222/154
9,919,306 B2 * 3/2018 Fuchs ..... A61M 5/31505
2005/0220676 A1 10/2005 Tran
2013/0291660 A1 * 11/2013 Wilmer ..... B01L 3/0224 73/864.13
2015/0209777 A1 * 7/2015 Petrek ..... B01L 3/0231 73/864.18
2017/0028397 A1 2/2017 Dudek
2017/0113219 A1 * 4/2017 Kim ..... B01L 3/5021
2018/0178211 A1 6/2018 Dudek et al.
2018/0250667 A1 9/2018 Dudek et al.
2019/0224666 A1 * 7/2019 Tajima ..... B01L 3/02

OTHER PUBLICATIONS

Written Opinion for International Application No. PCT/EP2017/058597 dated May 12, 2017.
Preliminary French Search Report for French Patent Application No. 16 53223 dated Nov. 30, 2016.
Translation of Office action dated Feb. 24, 2021 for Japanese application No. 2018-553193.

* cited by examiner

PIPETTE FOR SAMPLING AN EXTENDED RANGE OF VOLUMES OF LIQUID

TECHNICAL FIELD

The invention relates to the field of sampling pipettes, also called laboratory pipettes or even liquid transfer pipettes, for sampling and dispensing liquid in containers or the like.

The pipettes concerned by the present invention are manual pipettes and motor pipettes. These pipettes are intended to be held in the hand by an operator, during liquid sampling and dispensing operations. For manual pipettes, these operations are made by moving a pipetting control knob, obtained by applying an actuation pressure on the same knob which is mechanically transferred to a control rod. On motor pipettes, the pressure of the operator onto the control knob generates a signal which is transmitted to the control unit of the pipette, such that the same triggers the movement of the control rod through an appropriate motor embedded in the pipette.

It is noted that the manual pipettes concerned by the present invention can have an electronic counter and/or display, the pipette thereby having a "hybrid" nature because it combines both a mechanical aspect and an electronic aspect.

STATE OF PRIOR ART

Since many years, designing sampling pipettes has undergone many improvements, essentially aiming at simplifying the pipettes designing, or even enhancing their ergonomies.

Usually, to benefit from an acceptable precision, the volume range that can be sampled by a pipette is between about 10% of the nominal volume, and 100% of this nominal volume corresponding to the maximum volume that the pipette can sample.

Consequently, when an operator has to pipette different samples extending on a wide range, these operations require the use of several pipettes. By way of example, when a series of operations require pipetting volumes falling within a range from 3 to 1,250 μl, it can be required to have the following three pipettes:

- a first pipette with a nominal volume of 30 μl, that can be used on a volume range from 3 to 30 μl;
- a second pipette with a nominal volume of 300 μl, that can be used on a volume range from 30 to 300 μl; and
- a third pipette with a nominal volume of 1,250 μl, that can be used on a volume range from 300 to 1,250 μl.

Under this situation, the plurality of pipettes ensures precision and accuracy performance, but it results in taking too much room on the lab bench.

DISCLOSURE OF THE INVENTION

One purpose of the present invention is thus to overcome at least partially the drawback identified above.

For this, the object of the invention is a sampling pipette comprising:

- a pipette body;
- a control rod translationally movable relative to the pipette body, along a longitudinal axis of the pipette; and
- a suction chamber.

According to the invention, the pipette also includes:

- a set of N concentric pistons, N corresponding to an integer higher than or equal to two, each of the pistons participating in delimiting said suction chamber; and

- a module for coupling the control rod with the set of N concentric pistons, said module being configured so as to be capable of being brought into N distinct configurations in which it provides coupling of the control rod with 1, 2, . . . , N pistons respectively.

The invention is thus remarkable in that it enables the volume range that can be sampled to be extended, by implanting several pistons within the pipette as well as a module for coupling the control rod with each of these pistons. Consequently, during a pipetting operation, the number of operating pistons is a function of the volume to be sampled.

This solution has the advantage of reducing the required number of pipettes when the pipetting operations require to sample various volumes, without altering the accuracy and precision performance of the pipette. As a result, there is advantageously a room gain on the lab bench. In addition, by replacing several pipettes by a single pipette, this offers a traceability possibility of a protocol by recording all the pipetting operations made with this same pipette.

Further, the pipette according to the invention has a reduced bulk, by virtue of a concentric arrangement of its pistons.

On the other hand, the present invention has at least any of the following optional characteristics, taken alone or in combination.

It is provided:

that the coupling module comprises at least one piston attachment finger radially extending relative to the longitudinal axis of the pipette, that at least N−1 pistons each have an attachment slot circumferentially oriented and open, the slots having different circumferentially lengths for each of said at least N−1 pistons, and that said pipette is configured such that the attachment finger is capable of being circumferentially moved in and out of the slots radially facing each other.

In other words, coupling/uncoupling each piston with the control rod is made by a bayonet type connection, with the finger making up the lug of this connection. By virtue of the inventive design which has been developed, the number of pistons coupled to the control rod simply depends on the relative angular position between the finger and the slots radially facing each other. This angular relative position can be manually obtained by the operator using an appropriate control member positioned on the pipette, or more preferentially, in an automatic way by virtue of motor means controlled by a control unit of the pipette.

However, the coupling module can take any other form supposed to be appropriate, without departing from the scope of the invention. By way of example, this module can be based on a mechanical, magnetic gripping, etc.

The coupling module comprises a coupling rotary member provided at its bottom end with said finger, and rotatably mounted at its top end to the control rod, along the longitudinal axis of the pipette.

The coupling rotary member is preferably made using two parts slidably mounted with respect to each other, along the longitudinal axis of the pipette, an expansion spring being arranged between both these parts so as to generate a strain tending to move them away from one another.

The coupling module includes a control rod extension translationally integral with the control rod, and said two parts of the coupling rotary member are respectively formed by a top part and a bottom part, the latter being translationally movably mounted along the longitudinal axis, relative to the control rod extension.

The coupling module further comprises a motion transforming body cooperating with the coupling rotary member such that a relative translation movement between them along the longitudinal axis simultaneously results in a relative rotation with respect to each other, also along the longitudinal axis. In other words, the cooperation between the motion transforming body and the coupling rotary member causes a helical motion of the latter.

Preferably, the motion transforming body includes at least one first helical ramp as well as at least one second helical ramp, and the coupling rotary member is provided with a follower roller which, when it cooperates with the first ramp enables the rotation of the coupling rotary member to be caused along a first direction of rotation and which, when it cooperates with the second ramp enables the rotation of the coupling rotary member to be caused along a second direction of rotation. This design enables coupling and uncoupling of the pistons to be achieved in a simple and reliable manner.

The sampling pipette is preferentially designed such that the rotation of the coupling rotary member along the first direction of rotation is achieved by a first overstroke downwards of the control rod from a purge stroke end position thereof, and the rotation of the coupling rotary member along the second direction of rotation is achieved by a second overstroke upwards of the control rod from a top pipetting position of this control rod. Thus, the pipette is designed to achieve coupling and uncoupling of the pistons by simple translations of the control rod, in overstrokes going respectively beyond the purge stroke and retracted from the top pipetting position. One of the advantages relative to this specificity resides in the pipette design simplicity, given that it is the same control rod, in a motion along a same translation degree of freedom, which makes it possible to perform alternately pipetting operations and piston coupling and uncoupling operations.

Preferably, the first overstroke is made acting against a strain generated by a first centring spring tending to repel the coupling rotary member upwardly relative to the motion transforming body, and the second overstroke is made acting against a strain generated by a second centring spring tending to repel the coupling rotary member downwardly relative to the motion transforming body.

Preferably, the pipette is configured such that the movement of the control rod is made manually or in a motorised manner, as previously indicated. In this regard, it is noted that hybrid pipettes are also within the scope of protection of the invention.

Preferably, the number N of pistons is higher than or equal to three, but a solution with two concentric pistons is also possible, without departing from the scope of the invention.

The sampling is preferentially designed so as to be able to sample a volume range from 0.5 to 1,250 μl, or designed so as to be able to sample a volume range from 500 to 10,000 μl.

The inner most piston is permanently integral with the coupling module. Alternatively, it could also be coupled and uncoupled to the control rod, via the coupling module. According to another alternative, it is the outermost piston which could be permanently integral with the coupling module.

The pipette comprises a control member for adjusting the volume to be sampled, of the knob, button-type or any other conventional form.

Finally, it is noted that the sampling pipette can be a single-channel or multi-channel pipette.

Further advantages and characteristics of the invention will appear in the non-limiting detailed description below.

BRIEF DESCRIPTION OF THE DRAWINGS

This description will be made with regard to the appending drawings in which:

FIGS. 10*a* to 11*b* depict the coupling module switching from the first to the second configuration;

FIGS. 14*a* to 15*b* depict the coupling module switching from the third to the second configuration; and FIGS. 16*a* to 17*b* depict the coupling module switching from the second to the first configuration.

DETAILED DISCLOSURE OF PREFERRED EMBODIMENTS

Figure 2:
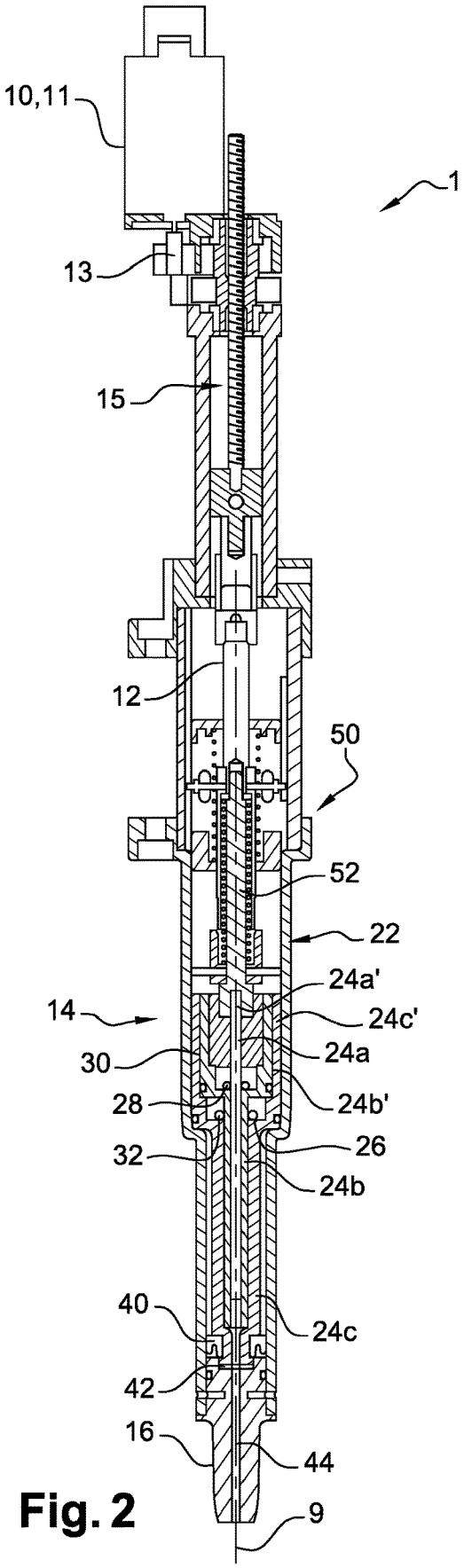
FIG. 2 is an axial cross-section view of a bottom part of the pipette shown in the previous figure.
Figure 1:
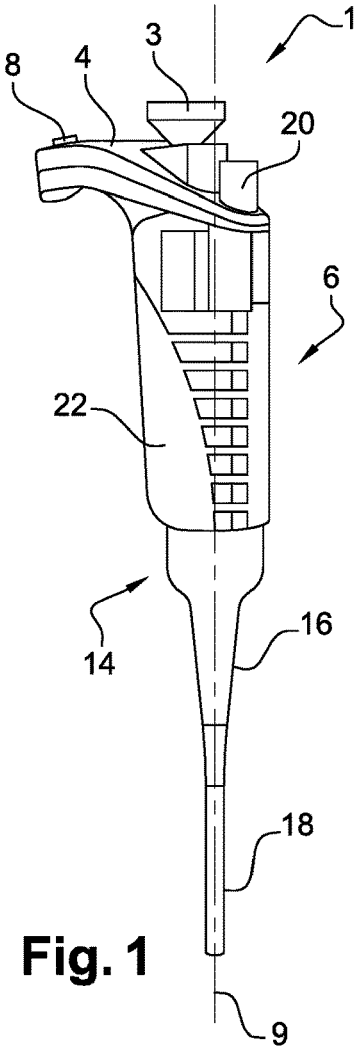
FIG. 1 represents a front view of a motor sampling pipette according to a preferred embodiment of the present invention.

In reference to FIGS. 1 to 5 first, a motor sampling pipette 1 is represented according to a preferred embodiment of the invention.

Conventionally, this motor pipette 1 is intended to be held by an operator's hand who, using his/her thumb, is capable of actuating a control knob of the pipette to generate dispensing a liquid which has been sucked beforehand.

More precisely, the single-channel pipette 1 comprises a handle 6 forming the upper body of the pipette, and above which the pipetting control button 3 is located, the upper part of which is intended to undergo the operator's thumb pressure. By way of indicating purposes, it is noted that an electronic display screen 4 is provided on the handle 6, as well as control members 8 such as knobs or buttons, and in particular a control member for adjusting the volume to be sampled.

The top part of the pipette is also provided with an electronic control unit 10 and a motor 11, the latter being preferentially a direct current motor controlled by the unit 10.

The output shaft 13 of the motor 11 is mechanically coupled to a device 15 for translating a control rod 12 of the pipette, along a longitudinal axis 9 of the pipette also corresponding to the longitudinal direction of the same. It is noted that most of the elements making up the pipette are of revolutionary shapes, and centred on this axis 9.

Under the handle 6, the pipette 1 includes a removable bottom part 14, which downwardly terminates with a cone-carrying tip 16 accommodating a consumable 18, also called a sampling cone.

A cone ejector 20 opens downwardly of the handle 6. Conventionally, the ejector 20 can be moved relative to the handle 6 and the bottom part 14, both forming a fixed body 22 of the pipette.

One of the features of the invention lies in the fact that the pipette is equipped with several concentric pistons, here three pistons referenced 24*a*, 24*b*, 24*c*. The number N of pistons could however be higher or lower than 3, without departing from the scope of the invention.

The three pistons are housed in the bottom part 14, and centred on the longitudinal axis 9. The first piston 24*a*, located inside, has a circular shaped cylindrical cross-section. The second piston 24*b* has an annular transverse cross-section, surrounding the first piston 24. The top end 24*b*' of the second piston 24*b* defines an upwardly open axial housing 26, and the bottom of which is equipped with an O-ring 28 through which the first piston 24*a* passes. However, usually for the second piston 24*b*, a small radial clearance is provided between both pistons 24*a*, 24*b*, such that air can penetrate therethrough. It is indicated that throughout the description, the terms "top" and "bottom" are to be considered with respect to the pipette maintained in the operator's hand, with an orientation such as that assumed during pipetting operations, that is with the control knob 3 upwardly oriented.

Analogously to that set out above, the top end 24*c*' of the third piston 24*c* defines an upwardly open axial housing 30, and the bottom of which is equipped with an O-ring 32 through which the second piston 24*b* passes. However, usually for the third piston 24*c*, a small radial clearance is provided between both pistons 24*b*, 24*c*, such that air can penetrate therethrough.

The third piston 24*c* has a bottom end equipped with a lip seal 40 snuggly fitting the internal surface of the fixed body 22.

Figure 4:
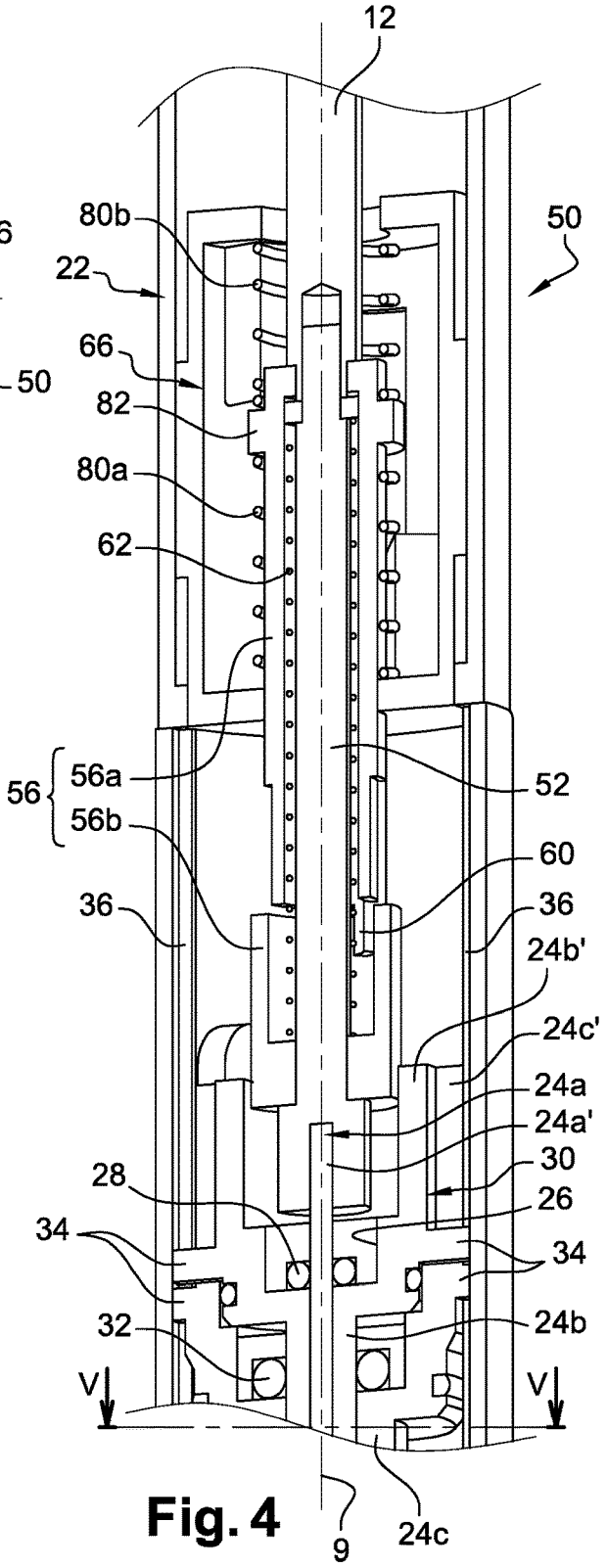
FIG. 4 is an axial cross-section view of the previous figure.

Each of the second and third pistons 24*b*, 24*c* has lugs 34 outwardly radially extending and slidably mounted in vertical internal grooves 36 of the fixed body 22, as is visible in FIG. 4. This enables the rotation of the pistons to be blocked relative to the fixed body 22 of the pipette.

The pistons participate with their lower ends in delimiting a single suction chamber 42, the bottom part of which communicates with a channel 44 passing through the cone-carrier 16.

By way of indicating example, the pipette is intended to enable liquid to be sampled in a volume range from 0.5 to 1,250 μl, or in a volume range from 500 to 10,000 μl. In the first case for example, a first piston 24*a* is provided, the intrinsic sampling capacity of which is in the order of 50 μl, and a second piston 24*b* is provided which, when associated with the first piston 24*a*, has together an intrinsic sampling capacity in the order of 350 μl, and finally a third piston 24*c* is provided which, when associated with the first and second pistons 24*a*, 24*b*, has an intrinsic sampling capacity in the order of 1,250 μl.

Depending on the desired volume, adjusted by the operator via the dedicated control member on the pipette, the control unit 10 is capable of commanding switching ON either:

the first piston 24*a* only;

the first and second pistons 24*a*, 24*b*;

the first, second and third pistons 24*a*-24*c*.

For this, the pipette 1 is equipped with a coupling module 50 specific to the invention, enabling each of the pistons to be coupled and uncoupled with the control rod 12. More precisely, the module 50 is configured so as to be able to be brought into three distinct configurations in which it provides coupling of the control rod 12 with the first piston 24*a* only, the first and second pistons 24*a*, 24*b*, and finally the first, second and third pistons 24*a*, 24*c* respectively.

Figure 3:
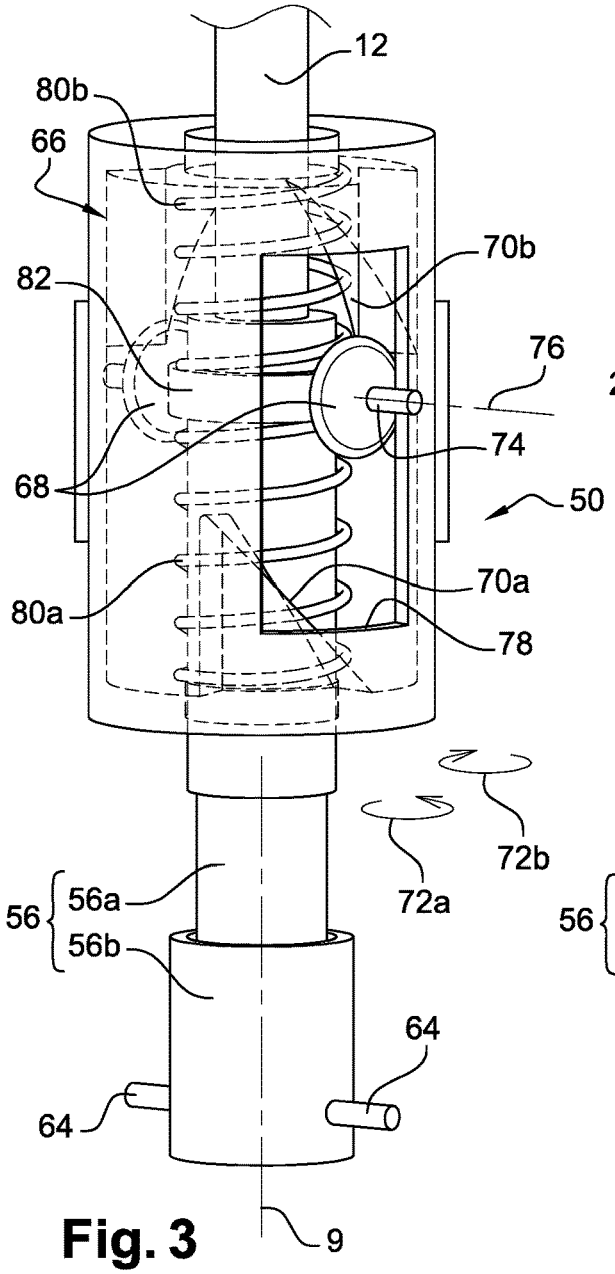
FIG. 3 is a perspective view of a piston coupling module implemented in the pipette shown in the previous figures.
Figure 5:
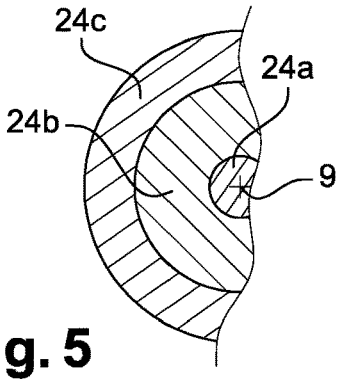
FIG. 5 is cross-section view taken along line V-V of the previous figure.

More specifically in reference to FIGS. 3 and 4, the coupling module 50 will now be described in more details.

First, the module 50 includes a control rod extension 52 translationally integral with the control rod 12, and downwardly extending from the same rod. Preferably, the extension 52 is mounted screwed at its top end to the bottom end of the control rod 12.

The bottom end of the extension 52, centred on the axis 9, fixedly and permanently carries the first piston 24*a*, a screwed, glued connection or else, being for example provided between their respective ends.

Further, the module 50 includes a coupling rotary member 56, arranged about the control rod extension 52. Preferably, this member 56 is made using two parts slidably mounted with respect to one another, along the axis 9. There is first a top part 56*a* translationally fixed with respect to the rod 12 and its extension 52, but rotatably movable relative to the same, along the axis 9. There is then a bottom part 56*b* rotatably coupled to the top part 56*a*, for example through a key 60.

An expansion spring 62 is arranged between both parts 56*a*, 56*b*, so as to generate a strain tending to move them away from one another. This expansion spring 62 presses against an internal pressing surface of the bottom part 56*b*, and a ring for coupling the upper ends of the top part 56*a* and the extension 52.

The bottom part 56*b* is thus translationally movably mounted along the axis 9, relative to the extension 52 and to the control rod 12. It is additionally equipped, at its bottom end, with at least one piston attachment finger 64, preferably two diametrically opposite fingers as is shown in FIG. 3.

Each attachment finger 64 radially outwardly extends from the bottom part 56*b*. As will be described hereinafter, the angular position of these fingers 64 conditions the number of pistons coupled to the module 50.

To vary the angular position of the fingers 64, the coupling module 50 further includes a motion transforming body 66, for transforming a translational motion into a rotational motion along the same axis 9. Indeed, this body 66 cooperates with the top part 56*a* of the coupling rotary member 56 such that a relative translation movement between both of them along the axis 9 simultaneously results in a relative rotation between them along the same axis. The aim is therefore to obtain a helical motion of the coupling rotary member 56, which is made possible thanks to ramps provided on the body 66 as well as follower rollers carried by the rotary member 56.

More precisely, the member 56 is equipped with two follower rollers 68 arranged in a diametrically opposite way, and rotatably mounted along a same transverse axis 76 orthogonal to the axis 9. A first helical ramp 70*a* located inside the body 66, as well as a second helical ramp 70*b* also located inside the body 66, facing the first ramp, are associated with each follower roller 68. The design is such that when each follower roller 68 cooperates with its associated first ramp 70*a*, it enables the rotation of the rotary member 56 to be caused along the first direction of rotation 72*a* about the axis 9. Reversely, when it cooperates with its associated second ramp 70*b*, it enables the rotation of the rotary member 56 to be caused along a second direction or rotation 72*b* opposite to the first direction.

It is additionally noted that each follower roller 68 is carried by a rotational support pin 74 centred on the axis 76, this pin opening into a radial opening 76 of the motion transforming body 66.

The axial positioning of the coupling rotary member 56 with respect to the body 66 is ensured by two compression springs, that is a first centring spring 80*a* tending to repel upwardly the member 56 relative to the body 66, and a second centring spring 80*b* tending to repel downwardly the coupling rotary member relative to the motion transforming body 66.

For this, the first spring 80*a* is housed inside the body 66 between a bottom end thereof and a shoulder 82 located at the top end of the rotary member 66, whereas the second spring 80*b* is housed inside the body 66 between a top end of the same and the same shoulder 82. It is additionally noted that it is on this shoulder that the follower rollers 68 are preferentially mounted, via the pins 74.

In reference now to FIG. 6, in combination with FIGS. 3 and 4, the cooperation between the coupling module 50 and the first and second pistons 24*b*, 24*c* will now be described, given that the first piston 24*a* remains permanently integral with this coupling module 50.

Figure 6:
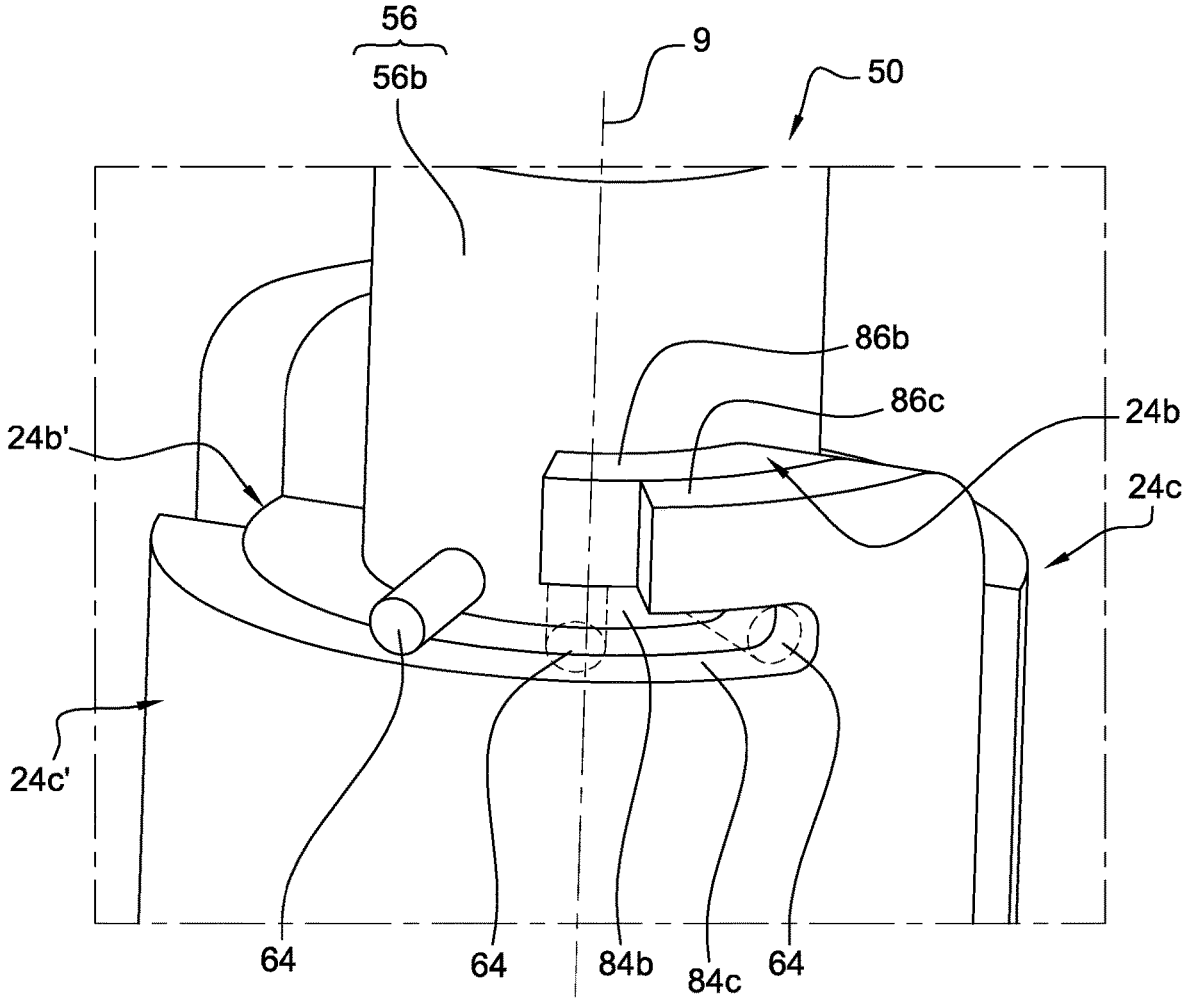
FIG. 6 is a perspective view of a bottom part of the coupling module shown in FIGS. 3 and 4, cooperating with the pistons of the pipette.

At its top end 24*b*', the second piston 24*b* has two diametrically opposite attachment slots 84*b* (a single one being visible in FIG. 6). Each slot 84*b* is circumferentially oriented, open in the same direction at one of its ends, and has a slot bottom at the opposite end. These slots 84*b*, for cooperating with the fingers 64 as lugs, are thus defined by notches 86*b* that would be considered as those of a bayonet connection.

Analogously, at its top end 24*c*', the third piston 24*c* has two diametrically opposite attachment slots 84*c* (a single one being visible in FIG. 6). Each slot 84*c* is also circumferentially oriented, open in the same direction at one of its ends, and has a slot bottom at the opposite end. These slots 84*c*, also for cooperating with the fingers 64 as lugs, are defined by notches 86*c* that could also be considered as those of a bayonet connection.

The slots 84*b*, 84*c* are gathered by pairs. For a same pair of slots 84*b*, 84*c* as that visible in FIG. 6, these are radially facing each other. In other words, they are considered as superimposed along the radial direction, by only partially covering each other along the circumferential direction. Indeed, both slots 84*b*, 84*c* of a same pair have different circumferential lengths, while having their slot bottoms aligned along the radial direction. Consequently, in the preferred embodiment which is described and represented in the figures, this implies that each notch 86*b* provided on the second piston 24*b* and delimiting the slot 84*b*, is longer than the notch 86*c* provided on the third piston 24*c* and delimiting the slot 84*c*.

The width of the slots 84*b*, 84*c* is preferentially identical, and provided such that the attachment fingers 64 can be circumferentially moved in and out these slots. Preferably, the slot width is slightly higher than the diameter of the fingers.

With this configuration, the number of pistons coupled to the bottom part 56*b* of the module 50 thus depends on the relative angular position between each finger 64 and its associated pair of slots 84*b*, 84*c*. FIG. 6 does depict this principle, since in a first configuration of the module 50 which is represented with the finger 64 in solid line, the same finger 64 assumes an angular position such that it is located outside the two slots 84*b*, 84*c*. In this first configuration, both pistons 24*b*, 24*c* are not coupled to each other, only the first piston remaining integral with the module 50. This first configuration is for example assumed by the control unit for pipetting volumes being in a range from 0.5 to 30 μl.

In a second configuration of the module 50, represented with the finger 64 in dotted line in the middle of FIG. 6, each finger 64 assumes an angular position such that it is located in the slot 84*b*, but outside the slot 84*c*. The cooperation between the finger 64 and the notch 86*b* is related to a bayonet connection. For example, an angular offset of 20 to 25° is provided between the position of the finger 64 of the first configuration, and that of the second configuration. In the same, both pistons 24*a*, 24*b* are therefore coupled to the module 50, but not the third piston 24*c*. This second configuration is for example assumed by the control unit for pipetting volumes being in a range from 30 to 300 μl.

In a third configuration of the module 50, represented with the finger 64 in dotted line in FIG. 6, the finger 64 assumes an angular position such that it is located in the slots 84*b*, 84*c*, close to or in contact with the slot bottoms. The cooperation between the finger 64 and the notches 86*b*, 86*c* is related to bayonet connections. For example, an angular offset of 20 to 25° is provided between the position of the finger 64 of the second configuration, and that of the third configuration. In the same, the three pistons 24*a*-24*c* are therefore coupled to the module 50. This second configuration is for example assumed by the control unit for pipetting volumes being in a range from 300 to 1,250 μl.

In reference now to FIGS. 7*a* to 7*c*, the operation of the pipette 1 will now be described when its coupling module 50 is in the first configuration, that is with only its first internal piston 24*a* coupled to this module.

Figures 7A, 7B, 7C:
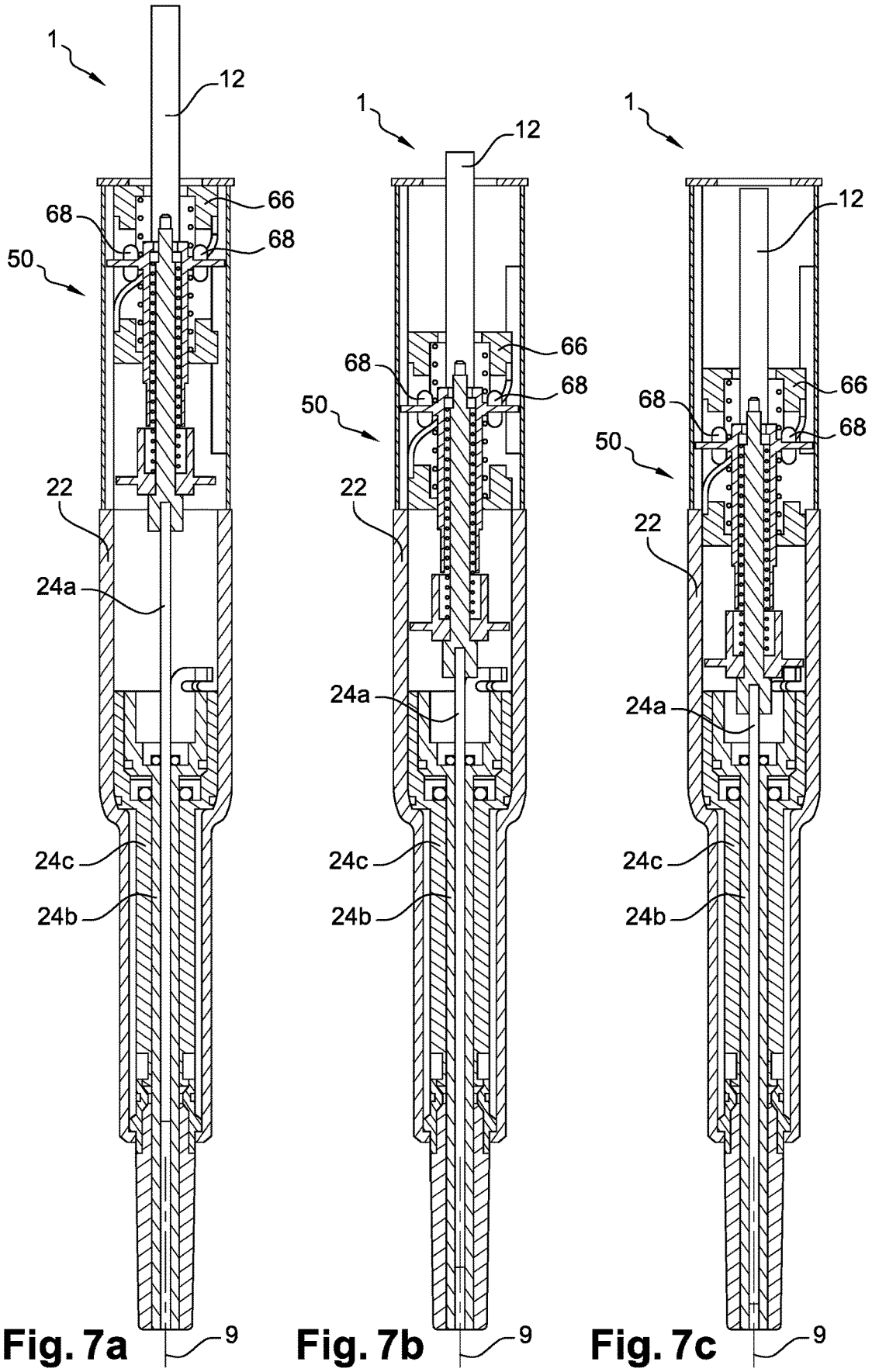
FIGS. 7*a* to 7*c* depict pipetting operations with the coupling module in a first configuration.

FIG. 7*a* shows the pipette 1 with its control rod in the top pipetting position, for example in a suction stroke end. The piston 24*a* coupled to the module 50 is thus in its topmost position relative to the fixed body 22 of the pipette. As regards the other two pistons 24*b*, 24*c*, they are in an inactive position abutting down against the fixed body 22. At this stage, the follower rollers 68 are substantially centred with respect to the motion transforming body 66, also in a top position.

Dispensing the sucked liquid is then controlled by the control knob, which causes actuation of the motor resulting in the control rod 12 to be downwardly moved. During this dispensing stroke, the downward motion of the rod 12 drives the module 50 which therefore also slides along the fixed body 22. As regards the pistons 24*b*, 24*c*, they remain stationary, unlike the first piston 24*a* which moves down. The state of the pipette at the dispensing stroke end is represented in FIG. 7*b*, whereas the continuing moving down of the rod 12 results in performing a purge stroke, the final state of which is represented in FIG. 7*c*.

Figures 8A, 8B, 8C:
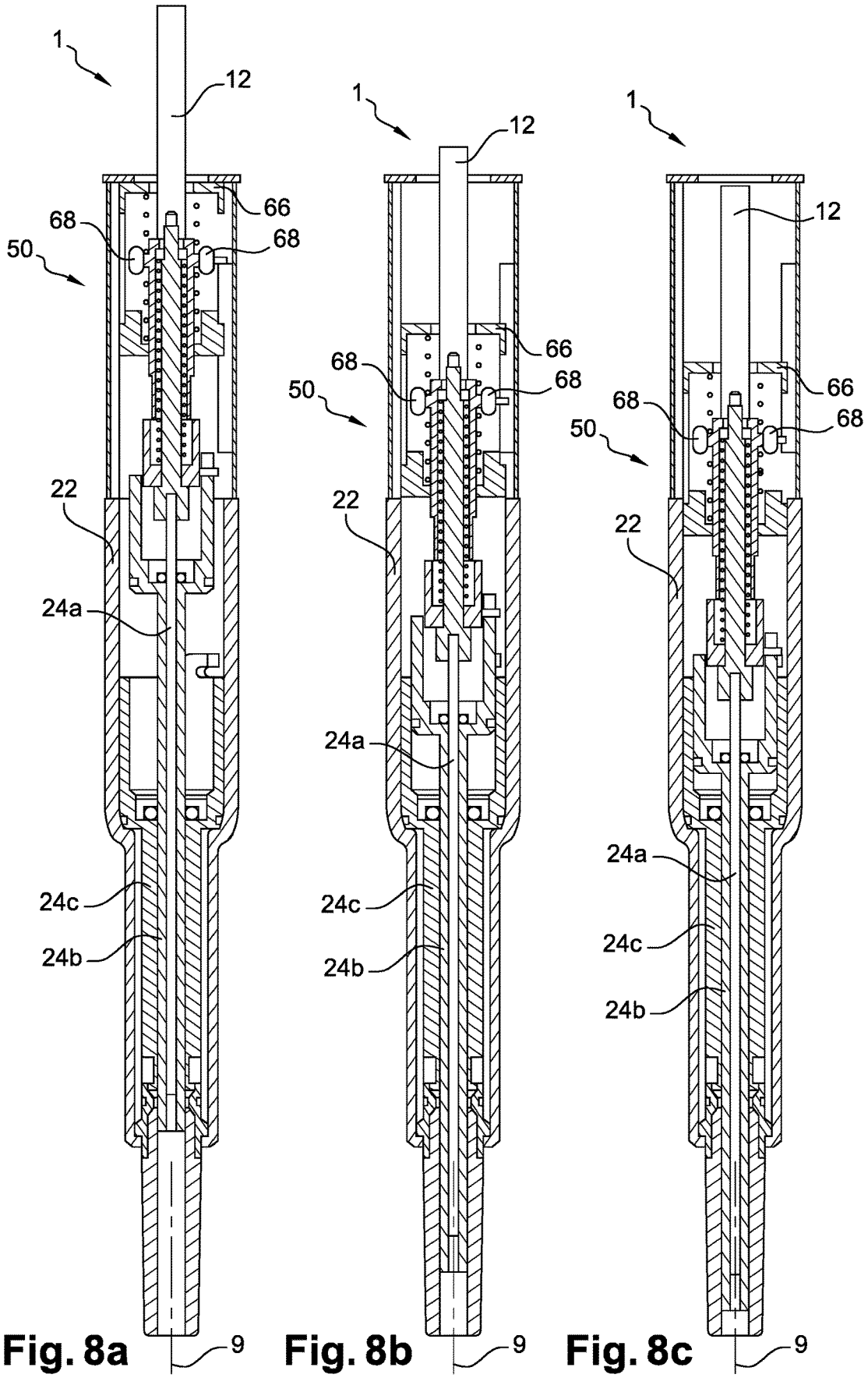
FIGS. 8*a* to 8*c* depict pipetting operations with the coupling module in a second configuration.

In reference now to FIGS. 8*a* to 8*c*, the operation of the pipette 1 will be described when its coupling module 50 is in the second configuration, that is with only its first and second pistons 24*a*, 24*b* coupled to this module.

FIG. 8 shows the pipette 1 with its control rod in the top pipetting position, for example at the suction stroke end. The pistons 24*a*, 24*b* coupled to the module 50 are in their topmost position relative to the fixed body 22 of the pipette. During pipetting, the relative axial position of both these pistons remains unchanged. As regards the third piston 24*c*, it remains in an inactive position abutting down against the fixed body 22. At this stage, the follower rollers 68 are substantially centred with respect to the motion transforming body 66, also in a top position.

Dispensing the sucked liquid is then controlled by the control knob, which causes actuation of the motor resulting in the control rod 12 being downwardly moved. During this dispensing stroke, the downward motion of the rod 12 drives the module 50 which therefore also slides along the fixed body 22. The pistons 24*c* remains stationary, unlike the pistons 24*a*, 24*b* which simultaneously move down. The state of the pipette at the dispensing stroke end is represented in FIG. 8*b*, whereas the continuing moving down of the rod 12 results in performing a purge stroke, the final state of which is represented in FIG. 8*c*.

In reference now to FIGS. 9*a* to 9*c*, the operation of the pipette 1 will be described when its coupling module 50 is in the third configuration, that is with all its pistons 24*a*-24*c*, coupled to this module.

Figure 9A:
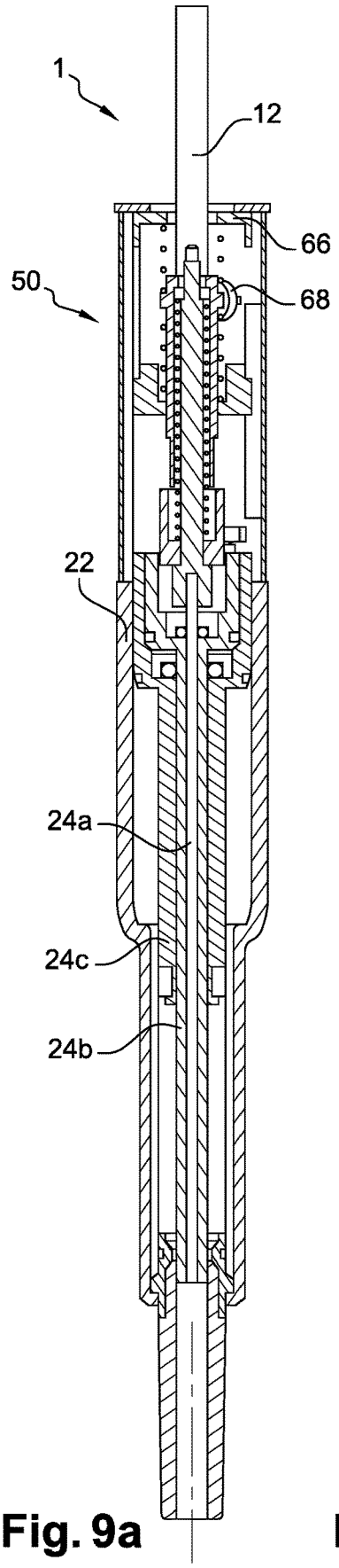
FIGS. 9*a* to 9*c* depict pipetting operations with the coupling module in a third configuration.
Figure 9B:
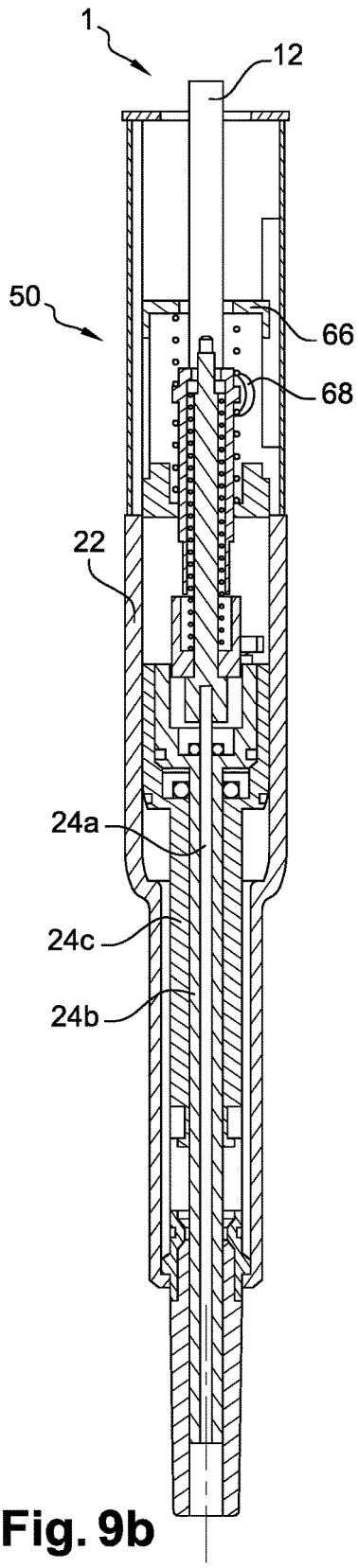
Figure 9C:
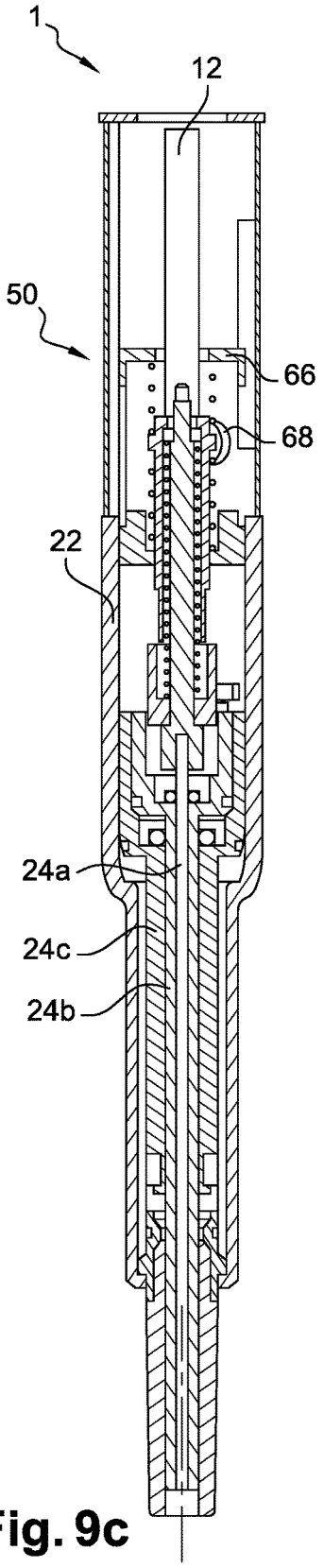

FIG. 9*a* shows the pipette 1 with its control rod in the top pipetting position, for example at the suction stroke end. The pistons 24*a*-24*c* coupled to the module 50 are in their topmost position relative to the fixed body 22 of the pipette. During pipetting, the relative axial position of these three pistons remains unchanged. At this stage, the follower rollers 68 are substantially centred with respect to the motion transforming body 66, also in a top position. As in the other two configurations, the position of the rollers 68 within the module is not caused to change during pipetting.

Dispensing the sucked liquid is then controlled by the control knob, which causes actuation of the motor resulting in the control rod 12 to be downwardly moved. During this dispensing stroke, the downward motion of the rod 12 drives the module 50 which therefore also slides along the fixed body 22. The three pistons 24*a*-24*c* then simultaneously move down, pushed by the rod 12 and the module 50. The state of the pipette at the dispensing stroke end is represented in FIG. 9*b*, whereas the continuing moving down of the rod 12 results in performing a purge stroke, the final state of which is represented in FIG. 9*c*.

FIGS. 10*a* to 10*c* and FIGS. 11*a* and 11*b* depict an operation aiming at switching from the first configuration to the second configuration of the module 50. For this, a first overstroke is commanded by the control unit, downward from the purge stroke end position as shown in FIG. 7*c*.

The body 66 first abuts down against the fixed body 22. As the first overstroke continues, the top part 56*a* of the rotary member 56 is rotated because of the follower rollers 68 pressing against their ramps 70*a*. This helical motion is transmitted to the bottom part 56*b*, as well as to its attachment fingers 64. It is made against the return strain generated by the first centring spring 80*a*, by compressing the same. During this motion, the fingers 64 of the bottom part 56*b* also axially abut down against the top ends 24*b*', 24*c*' of the pistons 24*b*, 24*c*, this state corresponding to that represented in FIGS. 10*a* and 11*a*. Then, the first overstroke is continued and the top part 56*a* continues to be helically driven, whereas the bottom part 56*b* only undergoes a rotation along the axis 9 in the first direction 72*a*, since it is translationally blocked. The relative translational motion between both parts 56*a*, 56*b* is made against the return strain generated by the expansion spring 62, by compressing the same.

During this rotation the angular extent of which is perfectly controlled because it directly depends on the extent of the axial overstroke of the control rod 12, the attachment fingers 64 penetrate the slots 84*b*. However, this angular movement of the fingers 64, for example in the order of 22.5°, is not sufficient for them to penetrate the slot 84*c*. The insertion of the fingers 64 into the slots 84*b* causes the second piston 24*b* to be coupled with the module 50. This mechanical coupling state is represented in FIGS. 10*b* and 11*b*.

Figures 10A, 10B, 10C:
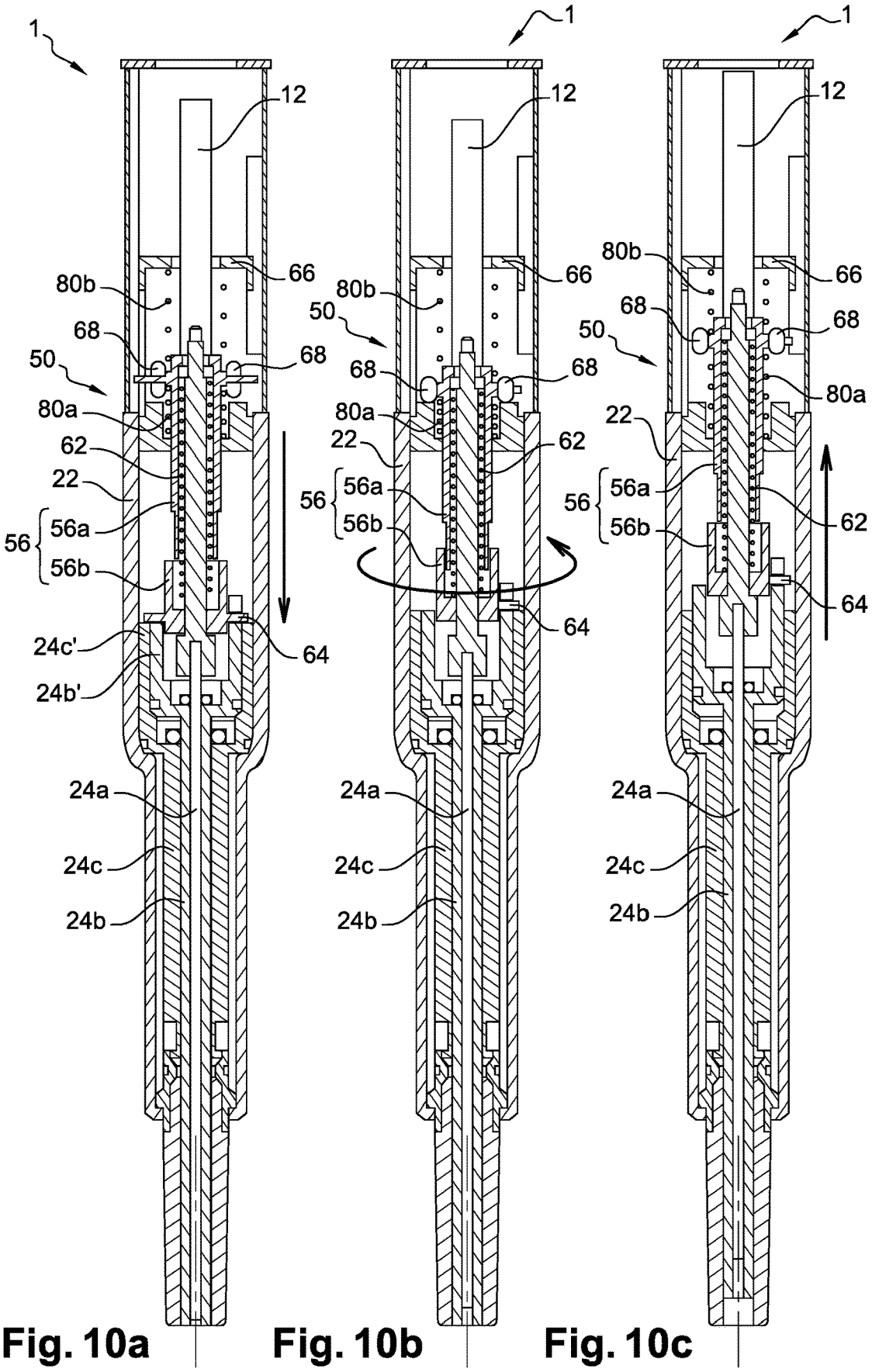
Figure 11A:
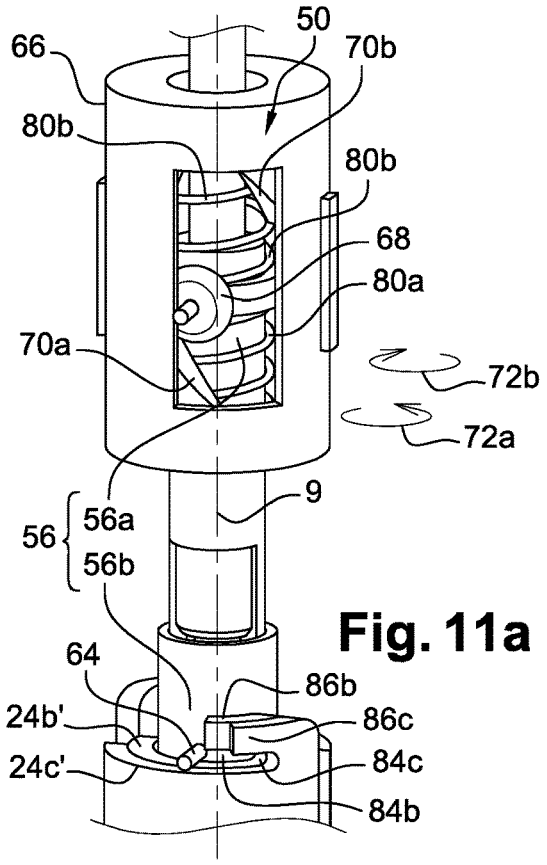
Figure 11B:
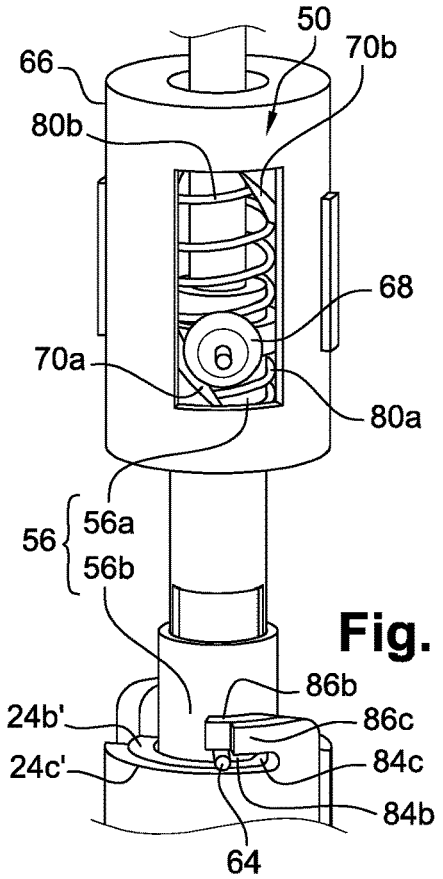

Once the coupling is made, the control unit of the pipette commands the rod 12 to be lifted back to the purge end position, which results in simultaneously lifting back the first and second pistons 24*a*, 24*b*, as is shown in FIG. 10*c*. As regards the third piston 24*c*, it remains in a fixed position.

Then, pipetting operations can be commanded conventionally, for volumes corresponding to the range associated with all of the two pistons 24*a*, 24*b*.

Figures 12, 12A, 12B, 12C:
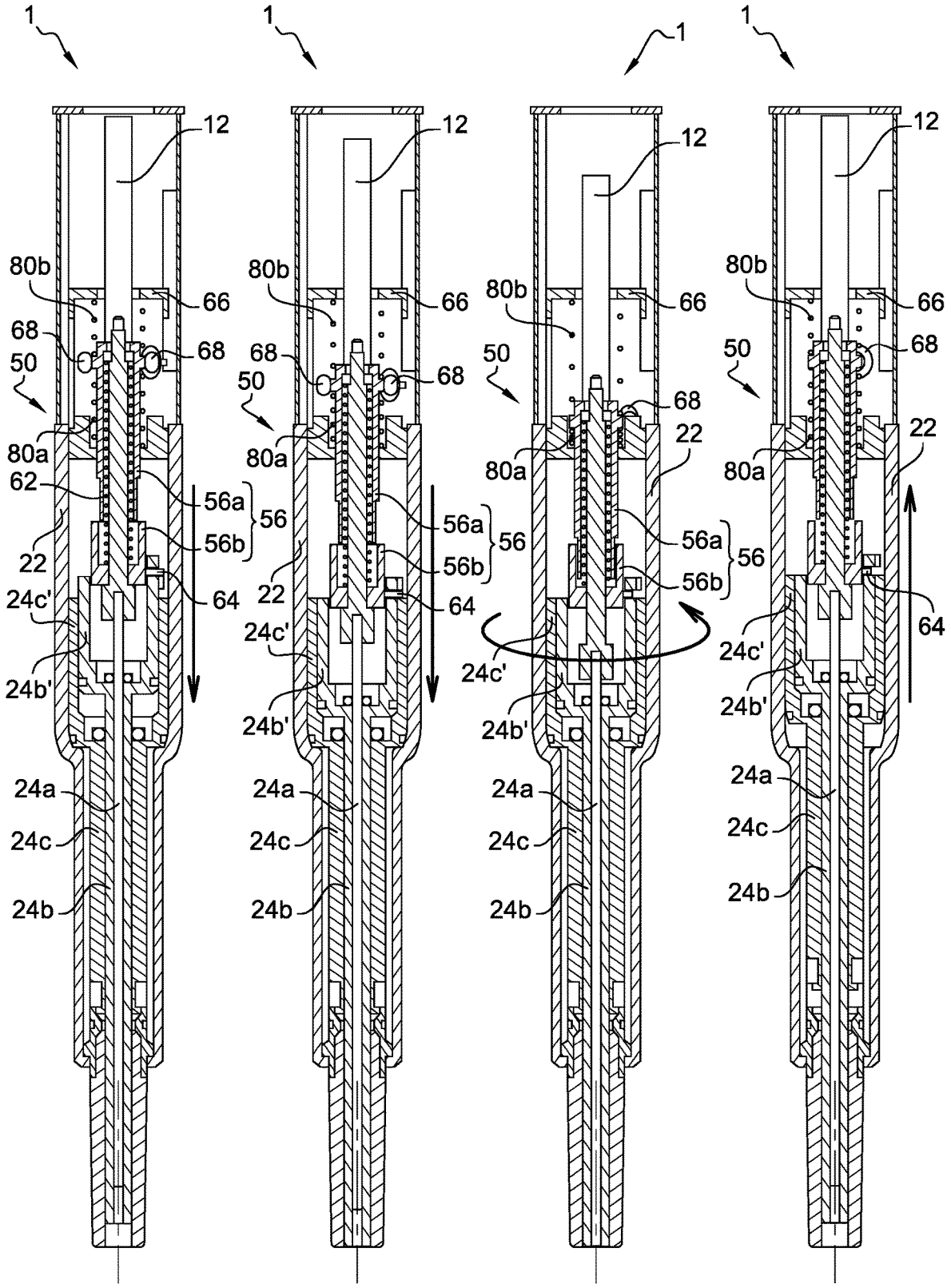

FIGS. 12 to 12*c* and FIGS. 13*a* and 13*b* depict an operation aiming at switching from the second configuration to the third configuration of the module 50. For this, another first overstroke with a larger amplitude than the previous one in commanded by the control unit, downwardly from the purge stroke end position as shown in FIG. 12.

The body 66 first abuts down against the fixed body 22. As the first overstroke is continued, the top part 56*a* of the rotary member 56 is rotated because the follower rollers 68 press against their ramps 70*a*. This helical motion is transmitted to the bottom part 56*b*, as well as to its attachment fingers 64. During this motion, the fingers 64 of the bottom part 56*b* then axially abut down against the top end 24*c*' of the piston 24*c*, this state corresponding to that represented in FIGS. 12*a* and 13*a*.

Figure 13A:
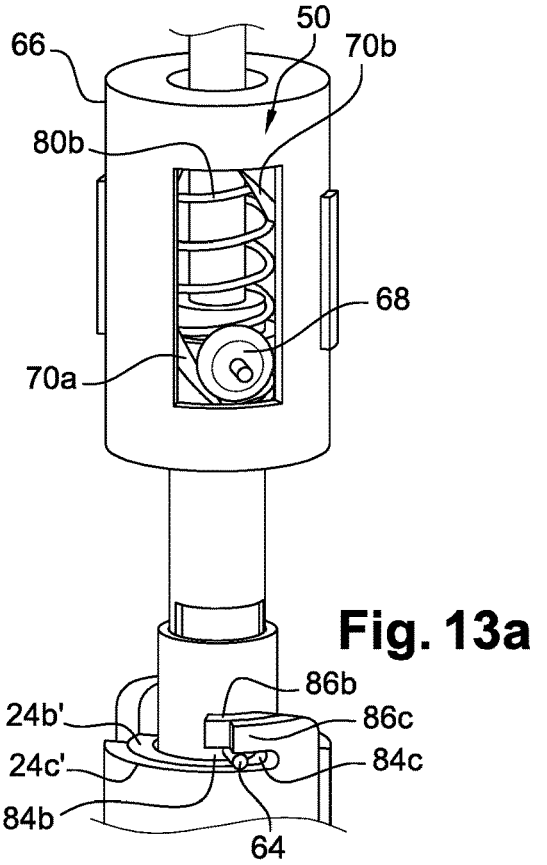
FIGS. 12 to 13*b* depict the coupling module switching from the second to the third configuration.
Figure 13B:
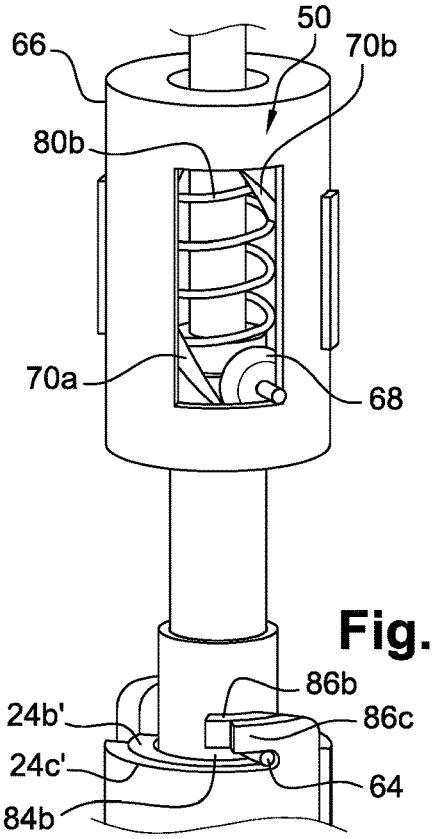

Then, the first overstroke is continued and the top part 56*a* continues to be helically driven downwardly, whereas the bottom part 56*b* only undergoes a rotation along the axis 9 in the first direction 72*a*, since it is translationally blocked. During this rotation the angular extent of which is perfectly controlled because it directly depends on the extent of the axial overstroke of the control rod 12, the attachment fingers 64 penetrate the slots 84*c*. This angular movement of the fingers 64 is for example in the order of 22.5°, and sufficient to come against or in the proximity of the bottom of the slots 84*b*, 84*c*. The insertion of the fingers 64 into the slots 84*c* causes the third piston 24*b* to be coupled with the module 50. This mechanical coupling state is represented in FIGS. 12*b* and 13*b*.

Once the coupling is made, the control unit of the pipette commands the rod 12 to be lifted back to the purge end position, which results in simultaneously lifting back the three pistons 24*a*-24*c*, as is shown in FIG. 12*c*. Then, pipetting operations can be commanded conventionally, for volumes corresponding to the range associated with all of the three pistons 24*a*-24*c*.

Of course, it is noted that directly switching from the first to the third configuration can be commanded by the control unit of the pipette, by adapting the amplitude of the first downward stroke accordingly.

Figures 14A, 14B, 14C, 14D, 16A, 16B:
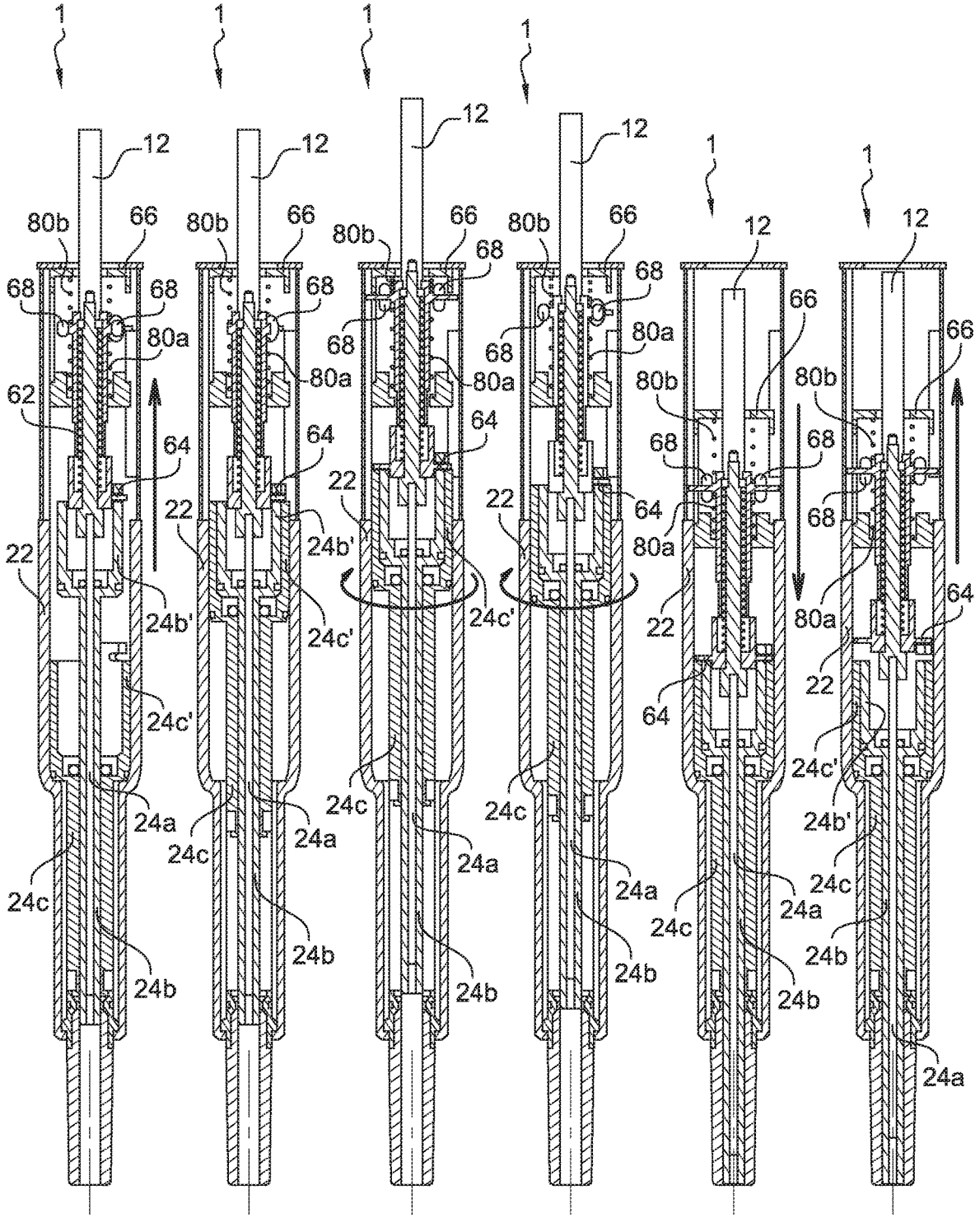

FIGS. 14*a* to 14*d* and FIGS. 15*a* and 15B depict an operation aiming at switching from the third configuration to the second configuration of the module 50. For this, a second overstroke is commanded by the control unit, upwardly from the top pipetting position as shown in FIG. 14*a*.

Figure 15A:
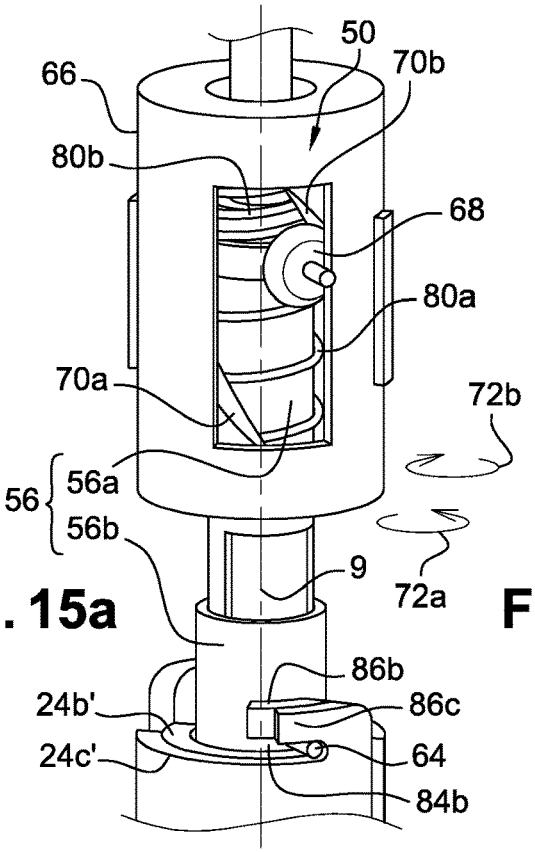
Figure 15B:
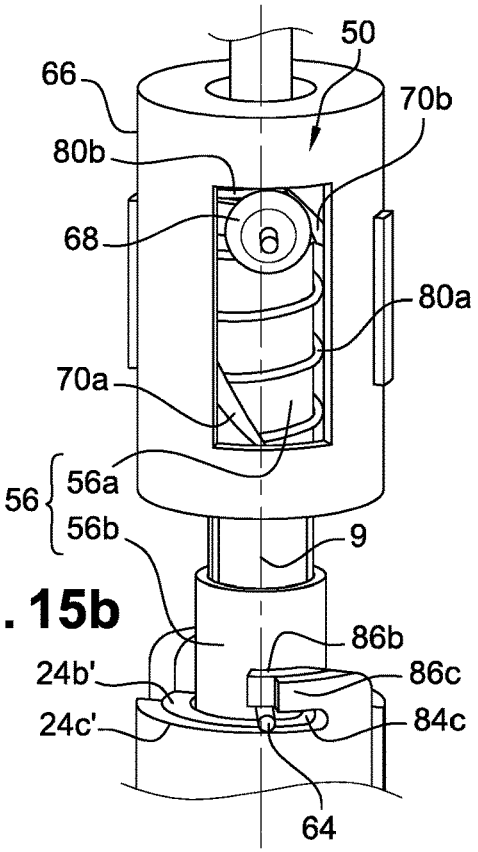

In this state of sampling the nominal volume associated with the third configuration, the body 66 is abutting up against the fixed body 22. As the second overstroke is continued upwardly, the top part 56*a* of the rotary member 56 is rotated because the follower rollers 68 press on their ramps 70*b*, as is depicted in FIG. 15*a*. This helical motion is transmitted to the bottom part 56*b*, as well as to its attachment fingers 64. It is made against the return strain generated by the second centring spring 80*b*, by compressing the latter. During this motion during which both pistons 24*b*, 24*c* slide while remaining rotatably fixed, the fingers 64 in helical motion progressively leave the slot 84*c*. At the end of the second overstroke, the fingers 64 are completely outside the slot 84*c*, such that the third piston 24*c* is uncoupled from the module 50. This state is shown in FIGS. 14*b* and 15*b*.

Then, the control unit of the pipette commands a downward movement of the control rod 12, such that the fingers 64 repel the third piston 24*c* in its bottom position, abutting against the fixed body 22. This phase is represented in FIG. 14*c*. It precedes the final lifting back phase of the module 50 and of both pistons 24*a*, 24*b*, by virtue of an upward axial movement of the control rod 12 as depicted in FIG. 14*d*.

Then, pipetting operations can be commanded conventionally, for volumes corresponding to the range associated with all of the two pistons 24*a*, 24*b*.

Figure 17A:
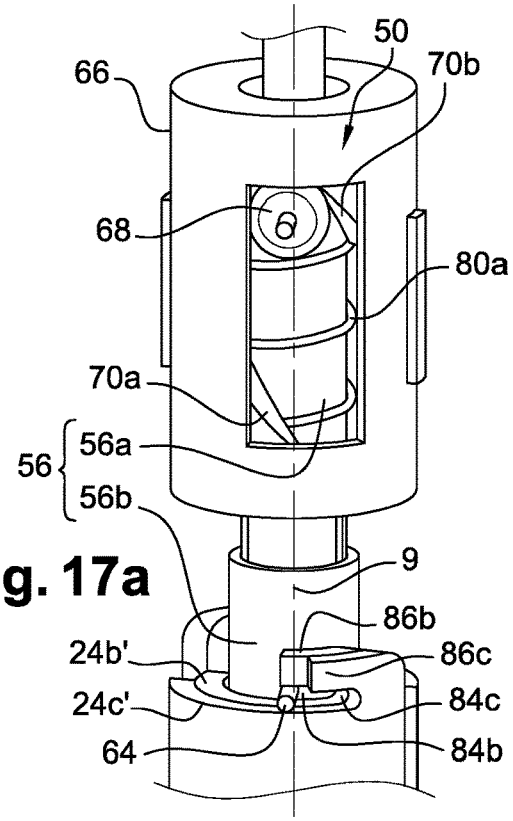
Figure 17B:
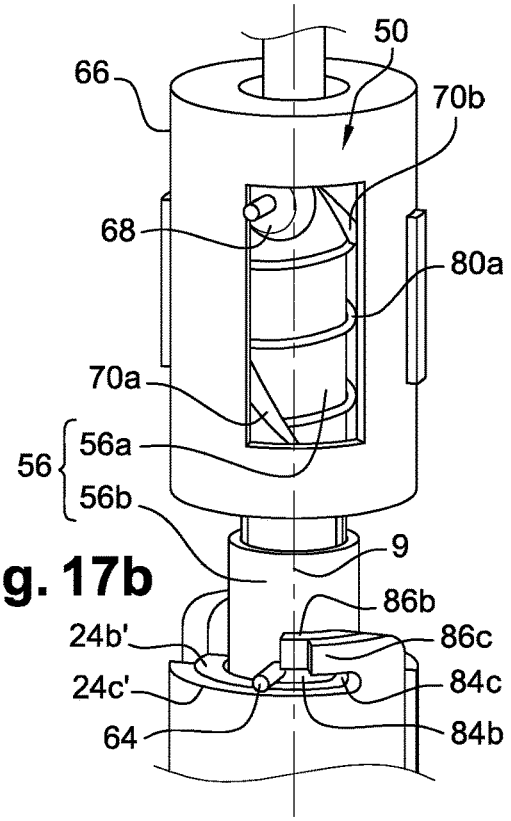

FIGS. 16*a* and 16*b* as well as FIGS. 17*a* and 17*b* depict an operation aiming at switching from the second configuration to the first configuration of the module 50. For this, another second overstroke with a larger amplitude than the previous one is commanded by the control unit, upwardly from the top pipetting position as shown in FIG. 16*a*.

In this state of sampling the nominal volume associated with the second configuration, the body 66 is abutting up against the fixed body 22. As the second overstroke is continued upwardly, the top part 56*a* of the rotary member 56 is rotated because the follower rollers 68 press on theirs ramps 70*b*, as is depicted in FIG. 16*a*. This helical motion is transmitted to the bottom part 56*b*, as well as to its attachment fingers 64. During this motion during which the piston 24*b* slides while remaining rotatably fixed, the fingers 64 in helical motion progressively leave the slots 84*b*. At the end of the second overstroke, the fingers 64 are completely outside the slots 84*b*, such that the second piston 24*b* is uncoupled from the module 50. This state is shown in FIGS. 16*b* and 17*b*.

Then, the control unit of the pipette commands the downward movement of the control rod 12, such that the fingers 64 repel the second piston 24*b* in its bottom position, abutting against the fixed body 22 or against the third piston 24*c* already in a down abutting position. This phase, similar to that represented in FIG. 14*c*, precedes the final lifting back phase of the module 50 and of the single piston 24*a*, by virtue of an upward axial movement of the control rod 12.

Then, pipetting operations can be commanded conventionally, for volumes corresponding to the range associated with the single first piston 24*a*.

Once again, it is noted that directly switching from the third to the first configuration can be commanded by the control unit of the pipette, by adapting the amplitude of the second upward stroke accordingly.

Of course, various modifications can be provided by those skilled in the art to the invention just described, only by way of non-limiting examples.

What is claimed is:

1. A sampling pipette comprising:

a pipette fixed body;

a control rod extending within the pipette fixed body and translationally movable relative to the pipette body, along a longitudinal axis of the pipette fixed body;

a suction chamber inside the pipette fixed body;

a set of N concentric pistons in the pipette fixed body located along the longitudinal axis, N corresponding to an integer higher than or equal to two, each of the N pistons are movable along the longitudinal axis within said suction chamber; and a coupling module in the pipette fixed body coupling the control rod with the set of N concentric pistons, the coupling module is configured to have N distinct configurations in which the coupling module provides a respective coupling of the control rod to each of the respective N pistons.

2. The sampling pipette according to claim 1, wherein the coupling module comprises at least one piston attachment finger radially extending from the coupling module relative to the longitudinal axis, wherein at least one piston has an attachment slot extending circumferentially about the at least one piston, the attachment slot having an open end, and wherein the attachment finger is movable circumferentially in and out of the attachment slot.

3. The sampling pipette according to claim 1, wherein the coupling module comprises at least one piston attachment finger radially extending from the coupling module relative to the longitudinal axis, wherein at least one of N pistons has an attachment slot extending circumferentially about the at least one piston, the attachment slot having an and open end, and wherein the at least one piston attachment finger is movable circumferentially in and out of the attachment slot.

4. The sampling pipette according to claim 3 wherein the coupling rotary member includes two parts slidably mounted with respect to each other, along the longitudinal axis, and an expansion spring disposed between the two parts and configured to generate a strain to move the two parts away from one another.

5. The sampling pipette according to claim 4, wherein the coupling module includes a control rod extension translationally integral with the control rod, and said two parts of the coupling rotary member being a top part and a bottom part respectively, the bottom part being translationally movably mounted along the longitudinal axis, relative to the control rod extension.

6. The sampling pipette according to claim 3, wherein the coupling module further comprises a motion transforming body engaging the coupling rotary member wherein a relative translation movement between the motion transforming body and the coupling rotary member along the longitudinal axis simultaneously results in a relative rotation of the motion transforming body and the coupling rotary member, also along the longitudinal axis.

7. The sampling pipette according to claim 6, wherein the motion transforming body includes at least one first helical ramp and at least one second helical ramp, and the coupling rotary member comprises a follower roller, wherein the follower roller is configured to engage the at least one first ramp and cause the at least one first ramp to produce a rotation of the coupling rotary member along a first direction of rotation, and wherein the follower roller is configured to engage the at least one second ramp and cause the at least one second ramp to produce a rotation of the coupling rotary member along a second direction of rotation.

8. The sampling pipette according to claim 7, wherein the coupling rotary member is configured so that the rotation of the coupling rotary member along the first direction of rotation is caused by a first overstroke downwards of the control rod from a purge stroke end position, and the rotation of the coupling rotary member along the second direction of rotation is caused by a second overstroke upwards of the control rod from a top pipetting position of the control rod.

9. The sampling pipette according to claim 8, further comprising a first centering spring and a second centering spring, wherein the first overstroke acts against a strain generated by the first centering spring that repels the coupling rotary member upwardly relative to the motion transforming body, and the second overstroke acts against a strain generated by the second centering spring that repels the coupling rotary member downwardly relative to the motion transforming body.

10. The sampling pipette according to claim 1, further comprises a motor configured to move the control rod or the control rod is configured to be moved manually.

11. The sampling pipette according to claim 1, wherein the number N of pistons is higher than or equal to three.

12. The sampling pipette according to claim 1, wherein the sampling pipette has a volume range from 0.5 to 1,250 μl, or from 500 to 10,000 μl.

13. The sampling pipette according to claim 1, further comprising a control member for adjusting a volume to be sampled.

14. The sampling pipette according to claim 1, wherein the set of N concentric pistons includes an innermost piston that is permanently integral with the coupling module.

15. The sampling pipette according to claim 1, wherein the coupling module comprises at least one piston attachment finger radially extending from the coupling module relative to the longitudinal axis, wherein two pistons of the N pistons each have an attachment slot extending circumferentially about each respective piston, each attachment slot having an open end and a different circumferentially length from the respective other attachment slot, the two attachment slots radially face each other, and wherein the at least one attachment finger is circumferentially movable in and out of the two attachment slots.

* * * * *